US006047638A

United States Patent [19]

Taira

[11] Patent Number: 6,047,638

[45] Date of Patent: Apr. 11, 2000

[54] STAMP DEVICE WITH A POROUS BASE PLATE AND ITS METHOD OF MANUFACTURE

[75] Inventor: Hiroshi Taira, Ichinomiya, Japan

[73] Assignee: Brother Kogyo Kabushiki Kaisha, Nagoya, Japan

[21] Appl. No.: 08/948,592

[22] Filed: Oct. 10, 1997

[30] Foreign Application Priority Data

Oct. 16, 1996 [JP] Japan ..... 8-273635

[51] Int. Cl.[7] ..... B41K 1/56

[52] U.S. Cl. ..... 101/135; 101/333; 101/405

[58] Field of Search ..... 101/125, 327, 101/333, 405, 406

[56] References Cited

U.S. PATENT DOCUMENTS

| | | | |
|---|---|---|---|
| 2,346,023 | 4/1944 | Gold | 101/125 |
| 3,303,146 | 2/1967 | Chebiniak | 101/335 |
| 4,212,839 | 7/1980 | Funahashi | 101/333 |
| 5,611,279 | 3/1997 | Ando et al. | 101/333 |
| 5,636,569 | 6/1997 | Winston | 101/333 |
| 5,741,459 | 4/1998 | Ando et al. | 264/293 |

FOREIGN PATENT DOCUMENTS

| | | |
|---|---|---|
| 55-13729 | 1/1980 | Japan . |
| 5-058015 | 3/1993 | Japan . |
| 7-82505 | 4/1995 | Japan . |
| 7-89205 | 4/1995 | Japan . |
| 7-285258 | 10/1995 | Japan . |
| WO 95/09730 | 4/1995 | WIPO . |
| WO 95/11283 | 4/1995 | WIPO . |

*Primary Examiner*—Edgar Burr
*Assistant Examiner*—Daniel J. Colilla
*Attorney, Agent, or Firm*—Oliff & Berridge, PLC

[57] ABSTRACT

The ink to be impregnated into the figure portion 6 of the processed stamp plate 10 in the stamp device 11 is formed of polyoxyethylene-alkyl-phenyl ether and oil soluble dye melted therein and regulated to have the viscosity in a range of 300–2000 cps, more preferably, 500–1500 cps. This stamp device 11 can thus extremely improve all of stamping characteristics, i.e., stamping durability, ink spreading condition, ink seeping condition, ink permeation speed, and the number of trial stamping times.

8 Claims, 9 Drawing Sheets

FIG.10

| VISCOSITY (CPS) / QUALITY | 300 OR LESS | 300 ~ 500 | 500 ~ 1000 | 1000 ~ 1500 | 1500 ~ 2000 | 2000 OR MORE |
|---|---|---|---|---|---|---|
| STAMPING DURABILITY (IMAGE DENSITY) | × 0.6 ~ 0.65 | ○ 0.75 ~ 0.8 | ○ 0.75 ~ 0.8 | ○ 0.75 ~ 0.8 | ○ 0.75 ~ 0.8 | △ 0.65 ~ 0.75 |
| INK SPREAD CONDITION | × | △ | ○ | ○ | ○ | ○ |
| INK SEEPING CONDITION | × | ○ | ○ | ○ | ○ | ○ |
| INK PERMEATION SPEED(SECOND) | ○ 4 SEC | ○ 7 SEC | ○ 10 SEC | ○ 15 SEC | △ 20 SEC | △ 23 SEC |
| THE NUMBER OF TRIAL STAMPING (TIMES) | 5 | 8 | 10 | 10 | 12 | 20 |

STAMP DEVICE WITH A POROUS BASE PLATE AND ITS METHOD OF MANUFACTURE

BACKGROUND OF THE INVENTION

1. Field of the Invention

The present invention relates to a stamp device provided with a stamp plate constructed from a porous base plate wherein an ink impermeable melted-solidified portion and an ink permeable non-melted portion are formed by selectively heating and melting a stamp surface of the porous base plate having open cells, and a support member which supports the stamp plate from a plane thereof, and more particularly to a stamp device with improved various stamping characteristics by regulating the viscosity of ink to be impregnated in the non-melted portion of the stamp plate into a predetermined range.

2. Description of Related Art

Heretofore, a number of proposals have been made regarding stamp devices each using a stamp plate constructed from a porous base plate formed of cellular plastic or rubber having open cells therein, on which an ink permeable non-melted portion and an ink impermeable melted-solidified portion are formed by selectively heating and melting a stamp surface of the porous base plate by means of a thermal head. The ink permeable non-melted portion is the portion where open cells are left according to the shape of mirror images and the like to be stamped. The ink impermeable melted-solidified portion is the portion where open cells in the portion excepting the above part forming the mirror images are melted and solidified to be sealed.

As the ink to be impregnated in the non-melted portion formed in the stamp plate, the ink made of organic solvent and dye melted therein is generally used. For example, polyglycol butyl ether or tripropylene glycol butyl ether, etc. is used as the organic solvent. Oil soluble dye is used as the dye.

However, regarding the ink to be used in the stamp devices to stamping characters and the like shaped on the non-melted portion of the stamp plate, the ink using polyglycol butyl ether or tripropylene glycol butyl ether, etc. as the organic solvent as mentioned above, the viscosity of the ink has not been taken much into consideration. The stamping characteristics required for this kind of ink are usually apt to be opposite between the ink having too low viscosity and the ink having too high viscosity. It is accordingly difficult to regulate the viscosity of ink to satisfy all stamping characteristics required for the ink. Under the present circumstances, sufficient study on the viscosity of ink has not been made yet.

SUMMARY OF THE INVENTION

The inventor of this invention has examined variously stamping characteristics of ink including organic solvent and dye and as a result, found that various stamping characteristics required for the ink could be improved when the viscosity of the ink was regulated in a predetermined range.

The present invention has been made in view of the above circumstances and has an object to overcome the above problems and to provide a stamp device with improved stamping characteristics by regulating the ink to be impregnated in a non-melted portion of a stamp plate to have the viscosity in a predetermined range.

Additional objects and advantages of the invention will be set forth in part in the description which follows and in part will be obvious from the description, or may be learned by practice of the invention. The objects and advantages of the invention may be realized and attained by means of the instrumentalities and combinations particularly pointed out in the appended claims.

To achieve the objects and in accordance with the purpose of the invention, as embodied and broadly described herein, a stamp device of this invention comprising a stamp plate formed from a porous base plate having open cells therein, on a stamp surface of which an ink impermeable melted-solidified portion and an ink permeable non-melted portion are formed, and a support member for supporting the stamp plate from one side plane, wherein ink to be impregnated into the non-melted portion of the stamp plate is formed of organic solvent and dye melted therein and regulated to have viscosity in a range of 300 to 2000 cps.

In the above stamp device, the viscosity of ink to be impregnated in the non-melted portion of the stamp plate is regulated in a range of 300 cps (centipoise) to 2000 cps, so that various stamping characteristics such as stamping durability, ink spreading condition and others can be extremely improved.

BRIEF DESCRIPTION OF THE DRAWINGS

The accompanying drawings, which are incorporated in and constitute a part of this specification, illustrate an embodiment of the invention and, together with the description, serve to explain the objects, advantages and principles of the invention. In the drawings.

FIG. 10 is a table showing the relation between the viscosity of ink and each of stamping characteristics;

DETAILED DESCRIPTION OF THE PREFERRED EMBODIMENTS

A detailed description of a preferred embodiment of a stamp device embodying the present invention will now be given referring to the accompanying drawings.

Figure 1:
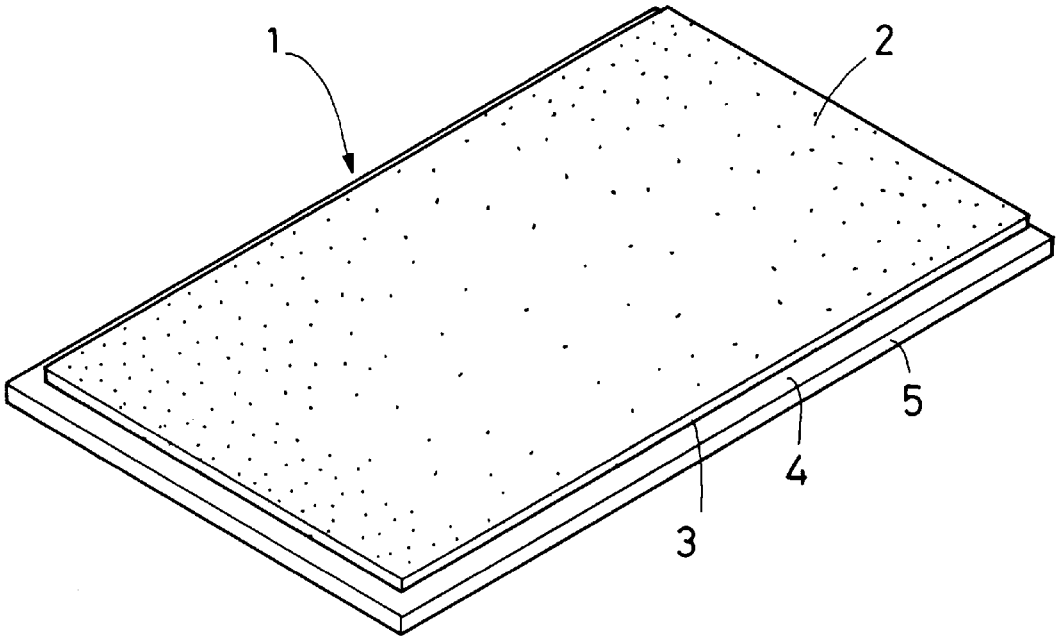
FIG. 1 is a perspective view of a stamp plate in the embodiment of the present invention.

A structure of a stamp plate to be used in the stamp device is first described with reference to FIG. 1. FIG. 1 is a perspective view of the stamp plate formed from a porous base plate having open cells, which is processed to make four side faces except upper and lower faces having a wider width be impermeable with ink.

In FIG. 1, the porous base plate forming the stamp plate 1 is made of rigid or semi-rigid rubber material having continuous fine cells therein, which is manufactured, for example, by heating and mixing polybutadiene and plasticizer (dibutyl phthalate), shaping the mixed material into a plate with a mold, and then removing the plasticizer therefrom to apply a predetermined heat treatment (annealing treatment) thereon.

Instead of the rubber material, usable is foamed plastic made of a selected one of polyolefine resin, polyurethane resin, vinyl chloride resin, ABS resin, ethylene-vinyl acetate copolymer, and other resin, each of which is rigid or semi-rigid and has open fine cells therein. These foamed plastics may be used by removing a surface layer covering the outside of the foamed plastic after foaming, and slicing it into a flat plate. Alternatively, one plane of the foamed plastic in contact with the mold for forming the foamed plastic may be used as a stamp surface of the stamp device. The thickness of the stamp plate 1 in the embodiment is about 1 to 3 mm.

As shown in FIG. 1, to form a stamp surface 2 in a predetermined region of an upper surface of the stamp plate 1, wherein cells are visible, other portions are pressed by a heated die to form a convex-shaped portions 3 and 4 and four side faces 5 below the convex-shaped portions 3 and 4 into melted-solidified portions. In these melted-solidified portions 3, 4 and 5, cells are covered with a thin film layer of ink impermeability. If a back surface (a lower surface in FIG. 1) of the stamp plate 1 is left as non-melted so as to be permeable with ink, a long-term ink supply in continuous stamping operations can be achieved by attaching an ink occlusion pad to the back surface of the stamp plate 1.

Figure 2:
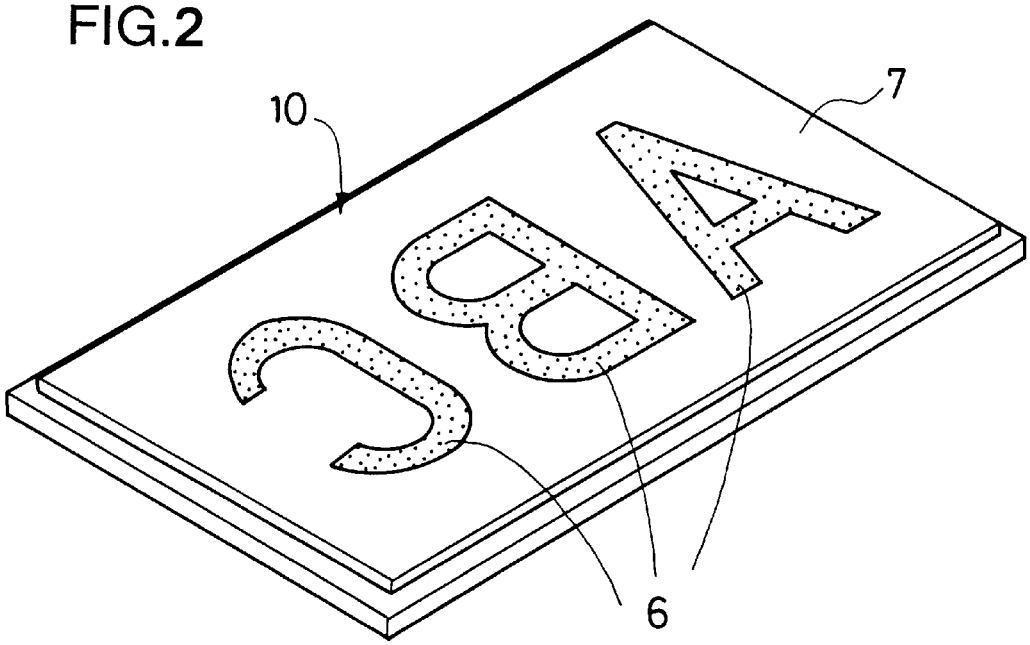
FIG. 2 is a perspective view of a processed stamp plate.

FIG. 2 is a perspective view of the stamp plate after processed on which figure portions 6 in the shape of mirror images of desired characters, figures and the like are formed on the stamp surface 2, which is referred to as a processed stamp plate 10 hereinafter. This finished stamp plate 10 is, for example, manufactured by a stamp making device 60 shown in FIG. 3 through FIG. 5.

Figure 3:
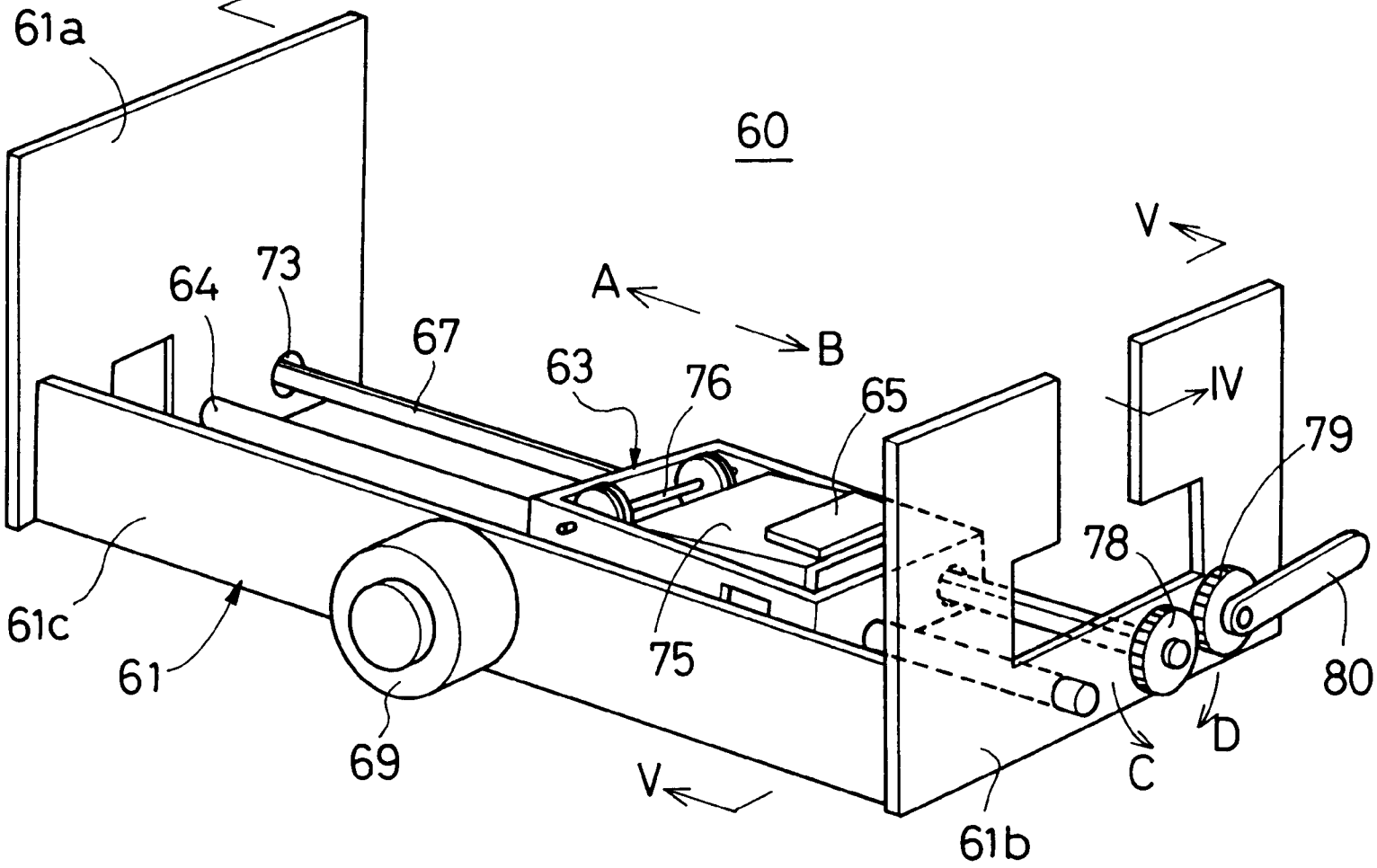
FIG. 3 is a perspective view of a main part of a stamp device.
Figure 4:
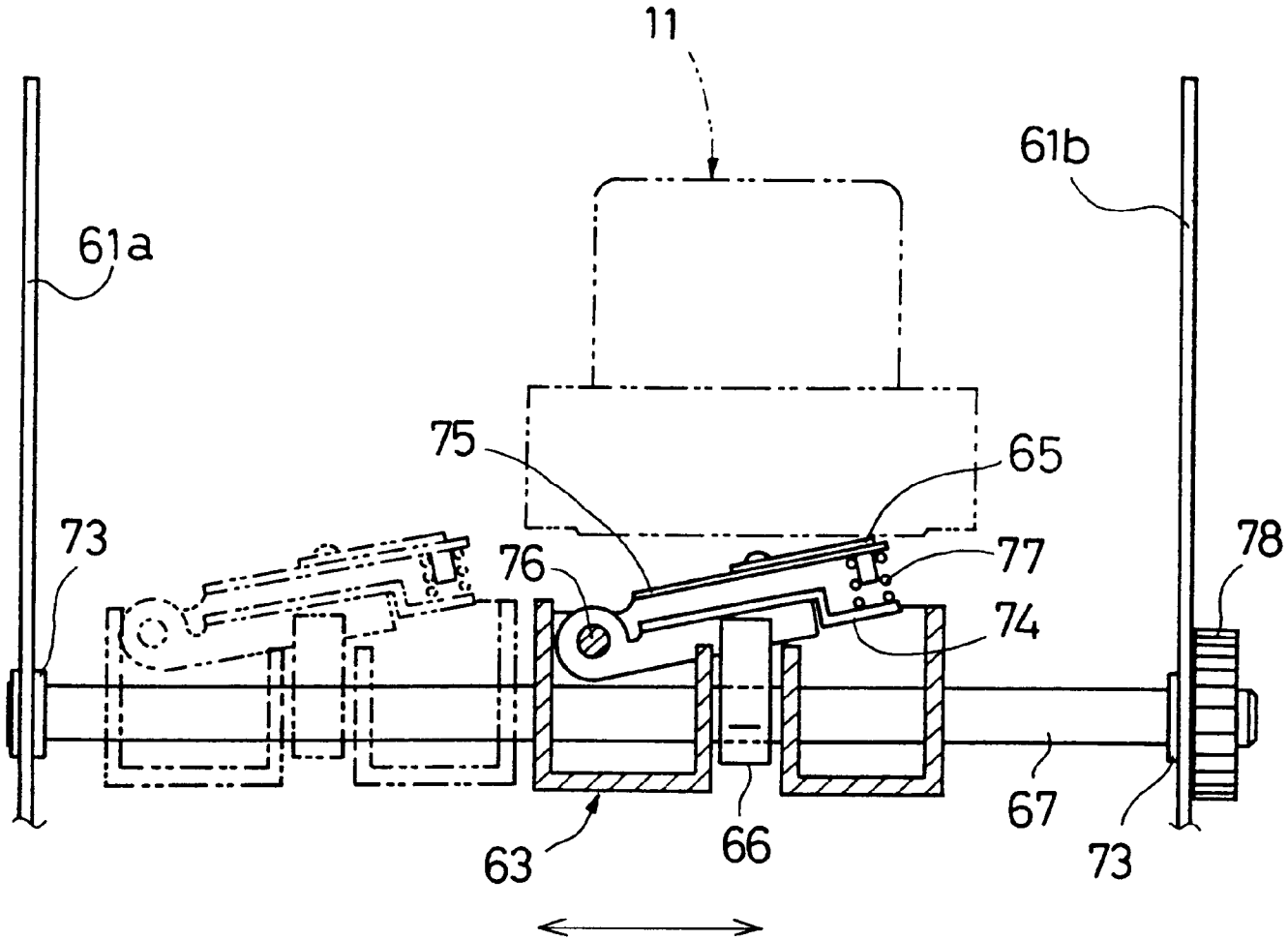
FIG. 4 is a sectional view of the stamp device of FIG. 3 viewed along a IV—IV line.
Figure 5:
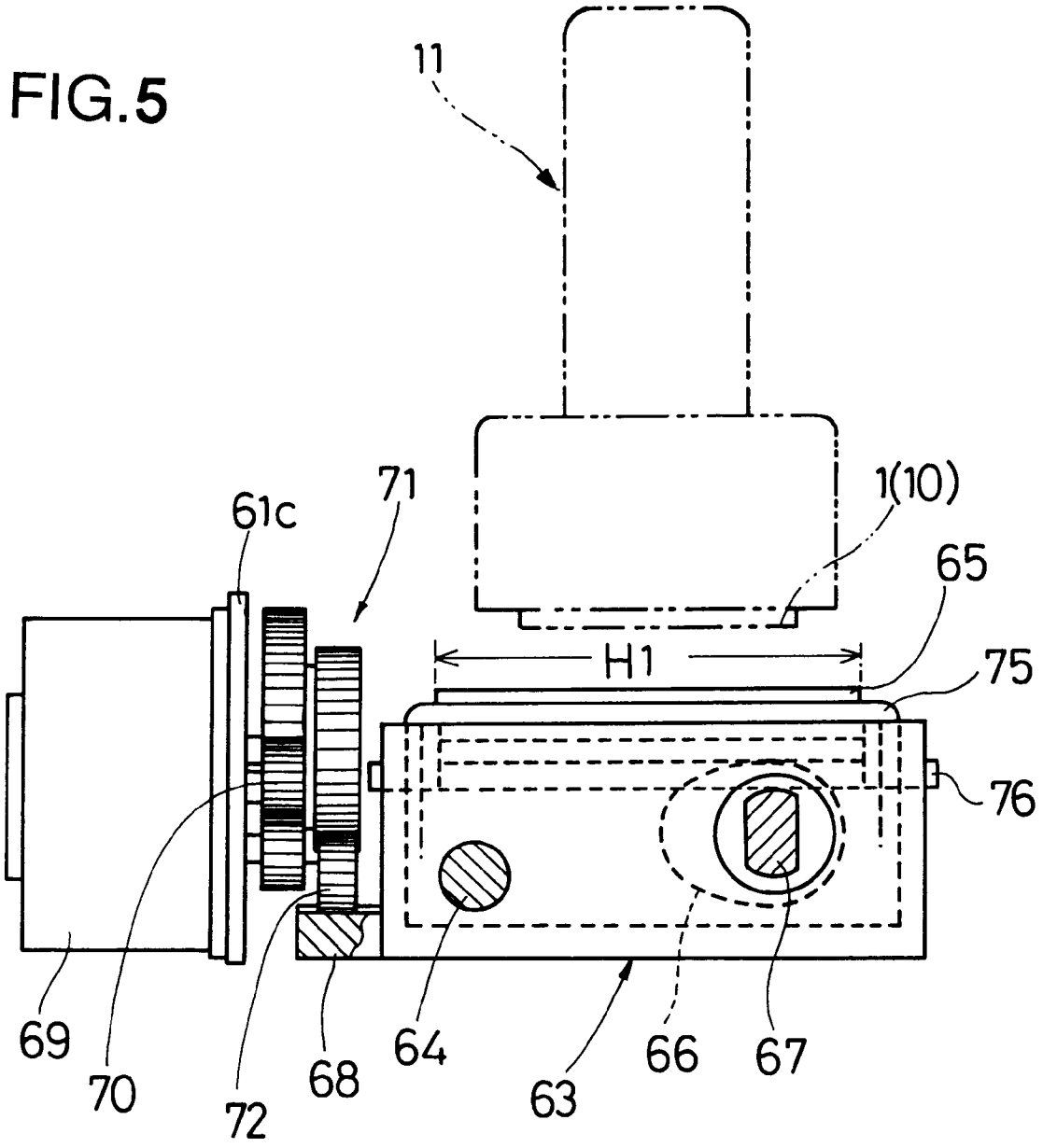
FIG. 5 is a sectional view of the stamp making device of FIG. 3 viewed along a V—V line.

In FIGS. 3 through 5, the stamp making device 60 is provided with a guide rod 64 to guide a carriage 63 in an axial direction and a head change rod 67 to guide the carriage 63 and operate a cam member 66 whereby a thermal head 65 mounted on the carriage 63 is moved up and down, both rods 64 and 67 being arranged between a right and left side walls 61*a* and 61*b* of a frame 61. The cam member 66 is mounted on the head change rod 67 so as not to be rotatable about the rod 67, but slidable in the axial direction. The head change rod 67 is rotatably supported in bearings 73 provided in the side walls 61*a* and 61*b*.

The stamp plate 1 is attached on a lower surface of a stamp device 11 mentioned later. This stamp device 11 is fixedly positioned above the moving carriage 63 by a supporting means not shown. The carriage 63 is mounted on the guide rod 64 and the head change rod 67 so as to be movable in the axial direction of the rods 64 and 67. At a front end (a left end in FIG. 5) of the carriage 63, a rack 68 having an appropriate length in a longitudinal direction of the carriage 63 is integrally fixed with an appropriate fixing means. The carriage 63 can be moved in a lateral direction (indicated by arrows A and B in FIGS. 3 and 4) by a power transmitted from a driving pinion 70 of a driving motor 69 which is reversely rotatable and fixedly mounted on a front wall 61*c* of the frame 61 through a group of reduction gears 71 arranged on a back surface of the front wall 61*c* to an engaging gear 72 which is engaged with the rack 68.

The carriage 63 is provided with a cam contact plate 74 and a heat release plate 75, both of which are mounted rotatably upward and downward about a support shaft 76 arranged in an orthogonal direction with respect to the head change rod 67, and a thermal head 65 fixed on the upper end side of the heat release plate 75. This heat release plate 75 is always pressed elastically by means of a spring 77 disposed between the cam contact plate 74 and the heat release plate 75.

The cam member 66 is formed in the shape of an ellipse and the like thereby to come into contact with a lower surface of the cam contact plate 74. This cam member 66 can be changed its position according to rotation of the head change rod 67 in a direction indicated by an arrow C or D in FIG. 3. When the cam member 66 is positioned sideways, becoming oblong in a horizontal direction with respect to the head change rod 67, the heat release plate 75 mounting the thermal head 65 thereon is put down. When the cam member 66 is positioned oblongly in a vertical direction with respect to the rod 67, i.e., in a stand-up state, causing the rotation of the cam contact plate 74 in an upward direction, the heat release plate 75 is rotated upward through the cam contact plate 74 and the spring 77, whereby the thermal head 65 is pressed against the lower surface of the stamp plate 1 fixedly positioned above the carriage 63.

The rotation of the head change rod 67 in the direction C or D to change the position of the cam member 66 is caused by means of a gear 78 mounted on an end of the head change rod 67, a gear 79 supported on the right end wall 61*b* and a lever 80 to rotate the gear 79.

The thermal head 65 has substantially the same structure as that of a well known thermal printer in which, for example, ninety-six point-like heating elements are arranged in a line in an orthogonal direction with respect to the arrow A, in which a length (H1 in the FIG. 5) of one line of the heating elements is a little longer than the width of the stamp plate 1.

The stamp making device 60 has a control unit not shown of microcomputer type including a central processing unit (CPU), a read-only memory (ROM), a random-access memory (RAM) and an interface and the like. The control unit drives the thermal head 65 and the driving motor 69. As shown in FIG. 4, the control unit controls the cam member 66 to be positioned in a stand-up state thereby to press the thermal head 65 against an end portion (an upper end in FIG. 4) of the stamp surface 2 of the stamp plate 1, and the thermal head 65 to activate all heating elements in one line, while activating the driving motor 69 to move the carriage 63 at a constant speed in the direction of the arrow A, thereby melting the part of the stamp surface 2 in contact with the thermal head 65, and then the melted part is solidified. Then a thin film which is impermeable with ink is formed on the melted-solidified part of the stamp surface 2, resulting in ink impermeable melted-solidified portion 7 (see FIG. 2). Succeedingly, in a predetermined part of the stamp surface 2, the thermal head 65 is controlled to allow the point-like heating elements not to emit heat in accordance with image dot patterns based on predetermined characters data input in advance and as a result, the predetermined part are not melted to form the figure portion 6 in the shape of mirror images of the predetermined characters as being permeable with ink, and other part becomes the melted and solidified portion 7 impermeable with ink. In this way, the processed stamp plate 10 can be manufactured. In the figure portion 6 of the processed stamp plate 10, the mean diameter of pores formed from the open cells is 10 to 50 $\mu$m.

A structure of the stamp device 11 will be described hereinafter with reference to FIGS. 6 to 9. In FIGS. 6 to 9, the stamp device 11 is constructed from the stamp plate 1 (processed stamp plate 10) in the shape of a substantially rectangular plate, a support member 12 for supporting the stamp plate 1 from the back surface. This support member 12 is rectangular in a plan view and is integrally or separately provided with a hand-hold portion 14.

Figure 6:
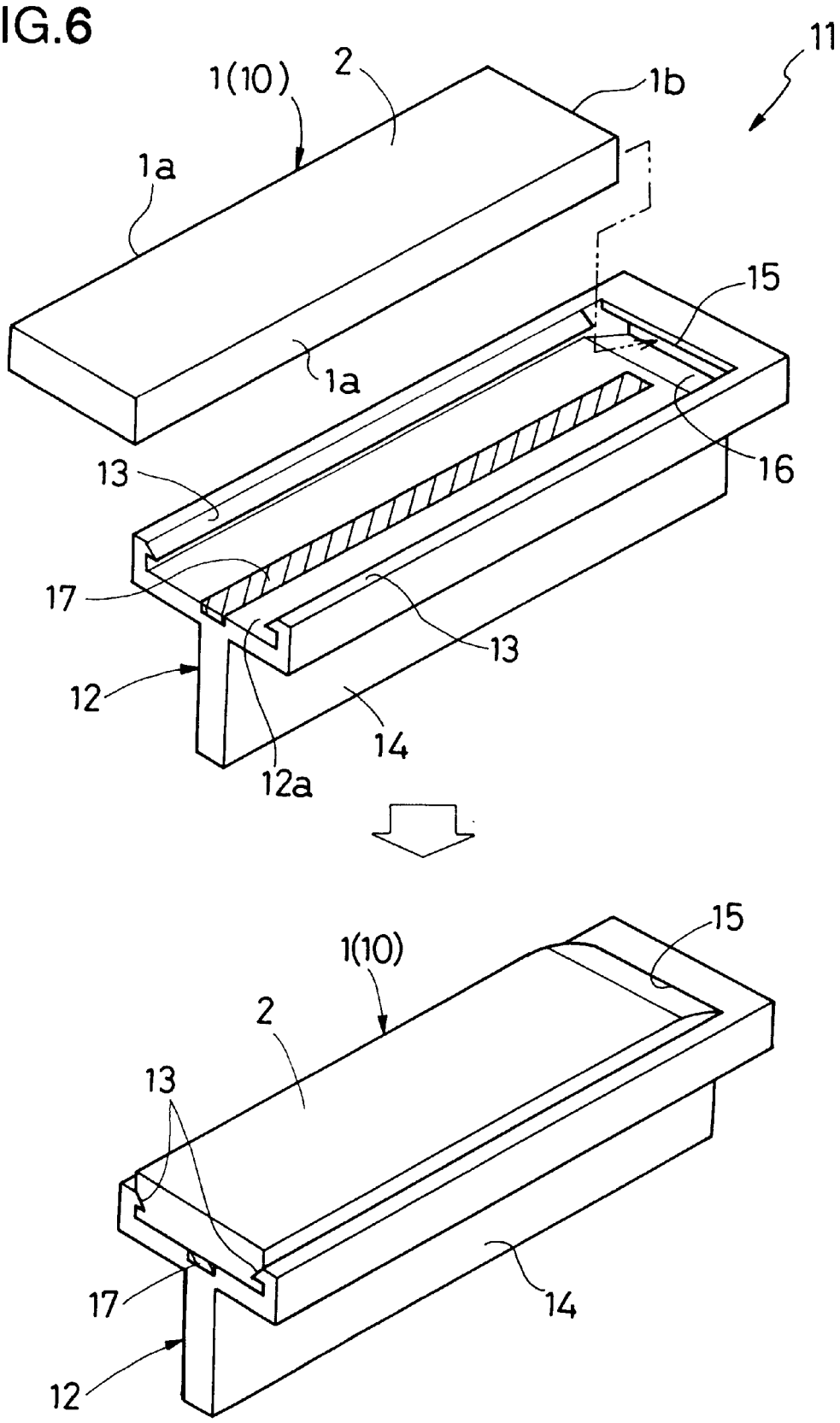
FIG. 6 is an explanatory view showing a work to assemble the stamp plate with a support member, constructing the stamp device in the embodiment.

The support member 12 is also provided, in its surface side (i.e., an upper side in FIG. 6), with a pair of longitudinal claws 13 formed in parallel with both longitudinal side faces 1*a* of the stamp plate 1, serving as engaging means to elastically hold the stamp plate 1, and a concave slot portion 15 formed in one end of the support member 12, in which an end face 1*b* orthogonal to the side faces 1*a* is inserted so as not to come off. On the surface side of the support member 12, as shown in FIG. 6, an inclination 16 is formed in the concave slot portion 15 and a pressure sensitive weak adhesive layer 17 is provided along a longitudinal direction of the claws 13.

With the above structure, the stamp plate 1 is assembled to the support member 12 by inserting one end (1*b*) of the stamp plate 1 along the inclination 16 into the concave slot portion 15 and then pushing the stamp plate 1 between the pair of claws 13 so as to stick the back surface of the plate 1 to the adhesive layer 17 between the pair of claws 13. In this way, the side opposite faces 1*a* or the lateral edge corner portions of the stamp surface 2 can elastically be engaged with the claws 13.

Accordingly, the back face of the stamp plate 1 is thus fixed to a part of a support plane 12*a* of the support member 12 by a weak adhesive strength of the pressure sensitive weak adhesive layer 17. The side opposite faces 1*a* and 1*a* are engaged with the pair of claws 13 and 13 of the support member 12. The end face 1*b* of the stamp plate 1 is fixed in the concave slot portion 15. Thus, the stamp plate 1 is securely assembled in the support member 12 and prevented from coming off.

Figure 7:
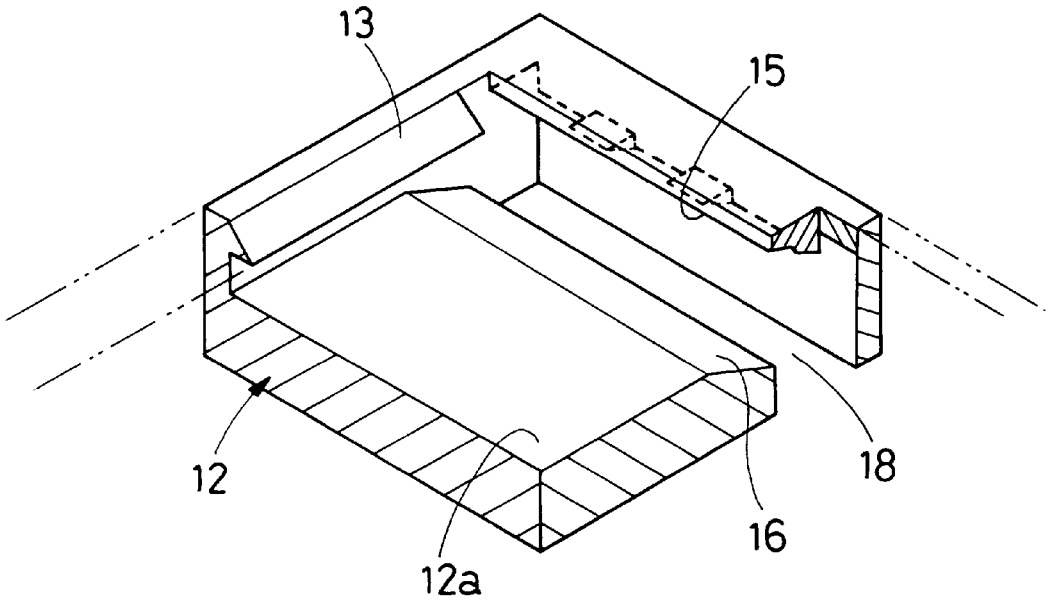
FIG. 7 is a partial perspective view of the support member.
Figure 8:
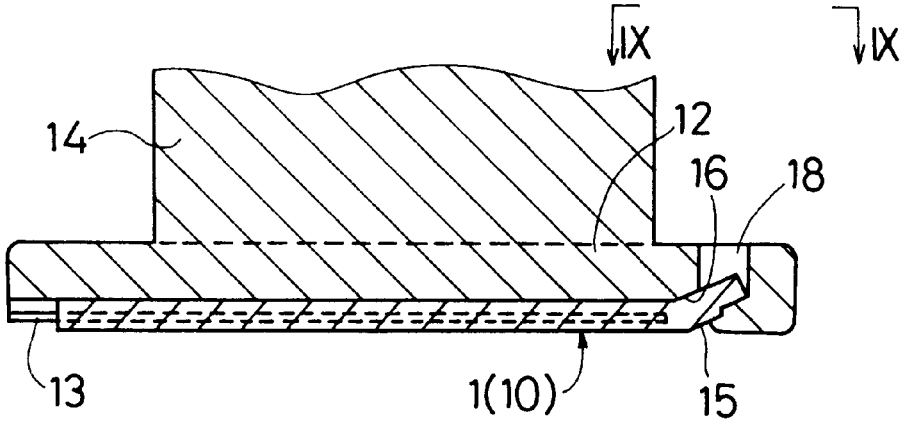
FIG. 8 is a side sectional view of the stamp plate assembled with the support member.
Figure 9:
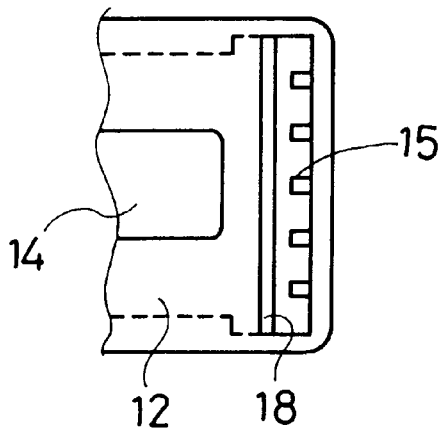
FIG. 9 is a partial view of FIG. 8 viewed along a IX—IX line.
Figure 11:
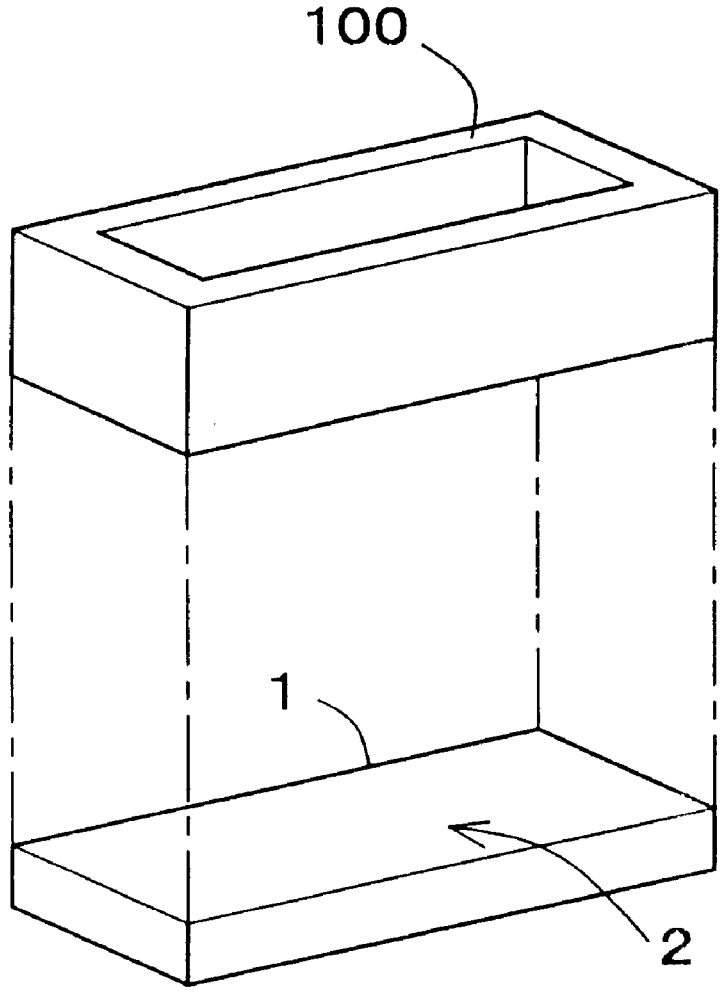
FIG. 11 is a perspective schematic view of the stamp plate and heated die that presses on the stamp plate.

The claws 13 may be formed longitudinally continuously along the side faces 1*a* (see FIG. 6) and, alternatively, formed intermittently so as not to partially hold the side faces 1*a*. As shown in FIGS. 7 through 9, an open hole 18 may be made in the concave slot portion 15 so as to go through a part of the support member 12.

Next, explanation is made on the ink to be used for stamping various images such as characters and the like by the use of the processed stamp plate 10 of the stamp device 11 according to the figure portion 6 of the processed stamp plate 10.

It was found that, as to the ink made of organic solvent and dye melted therein, polyoxyethylene-alkyl-phenyl ether was the most suitable for the organic solvent which can match well with rubber material forming the stamp plate 1, and oil soluble dye could be used as the dye.

Concerning the ink mentioned above, tests were made to measure the stamping characteristics of the ink having different viscosity by stamping images through the processed stamp plate 10. The results of those tests are shown in FIG. 10. The stamping characteristics evaluated here include the stamping durability representing the change in density of stamped images on paper according to the number of stamping times, the ink spread condition representing the degree of ink spreading in stamped images, the ink seeping condition representing the speed of ink going through the figure portion 6 from its front to back face side when the ink is dropped on the figure portion 6, the ink permeation speed representing the speed of ink permeating into the figure portion 6 of the processed stamp plate 10, and the number of stamping times required to remove excess ink after applying ink to the figure portion 6.

First, the stamping durability is explained below. This stamping durability was tested by preparing six kinds of ink with the viscosity of 300 cps or less, 300–500 cps, 500–1000cps, 1000–1500 cps, 1500–2000 cps, and 2000 cps or more, respectively, applying a predetermined amount (0.15 g) of each ink separately to the figure portions 6 of the stamp plates 10, and stamping images such as characters thirty times or more on regular paper by the use of the processed stamp plate 10 under the stamping load of 4 Kgf at 25° C. and, after that, measuring the density of the thirtieth stamped characters by a Macbeth permeation densitometer. The measurement results are shown in FIG. 10, where the desirable density is 0.75 or more.

In the result of the stamping durability in FIG. 10, it was confirmed that, in case of the ink viscosity of 300 cps or less, the density of the thirtieth stamped character was a low density of 0.6–0.65. It is believed that this is because the ink having too low viscosity is permeated fast into the figure portion 6, while the ink permeated into the figure portion 6 is easily transferred onto the regular paper in initial stamping operations of ten or twenty times. It is thus found that the ink having the viscosity of 300 cps or less is inferior in the stamping durability.

In case of the ink viscosity being in a range of 300 to 2000 cps, the density of each of the characters stamped at the thirtieth stamping operation was 0.75–0.8. This is satisfactory density. It is conceivable that this is because the ink can be well retained in the figure portion 6 of the processed stamp plate 10 due to the appropriate viscosity, and be transferred gradually every stamping time. It is found that the ink having the viscosity of 300 to 2000 cps is superior in the stamping durability.

Furthermore, in case of the ink viscosity being 2000 cps or more, the density of the character stamped at the thirtieth stamping time was a little low of 0.65–0.75. It is conceivable that as the viscosity of ink is higher, the ink is harder to permeate into the figure portion 6, so that the ink permeated in the figure portion 6 has been transferred onto regular paper during initial stamping operations of about twenty times. It is found that the ink with 2000 cps or more is a little inferior in the stamping durability.

The ink spreading condition will be explained hereinafter. This ink spreading condition was tested by separately applying the ink of six kinds prepared as mentioned above to the figure portions 6, stamping characters and the like on regular paper, and measuring the degree of ink spread of the stamped character with the eye. In the ink spreading test, the degree of the ink spreading condition exceeded an allowable range due to the ink with too low viscosity in case of 300 cps or less. The ink spreading degree also exceeded a little the allowable range in case of the viscosity being in a range of 300 to 500 cps. In case of the viscosity being 500 cps or more, to the contrary, the clearly stamped character with little spreading of ink was observed. It is found that the ink spreading degree of the stamped character becomes larger as the ink viscosity is lower, while the ink spreading degree becomes smaller as the ink viscosity is higher, resulting in the clearly stamped character.

The ink seeping condition is described below. This characteristic was tested by similarly preparing six kinds of ink as mentioned above, applying three droplets of the ink per kind to each of the figure portions 6, and keeping the stamp plates 10 in an ambient atmosphere of 45° C. to observe the condition of ink seeping on the back face of the figure portions 6 with the eye every twenty-four hours. In this test, the thickness of the processed stamp plate 10, i.e., the figure portion 6 was 2.3 mm and one droplet of ink was about 6 mmg. In the ink seeping condition in FIG. 10, it was confirmed that the ink has struck through the processed stamp plate 10 after a lapse of four days (ninety-six hours) in case of the viscosity being 300 cps or less. In case of the viscosity of 300 cps or more, however, any ink was not observed on the back surface of the processed stamp plate 10 even after a lapse of seven days (one hundred sixty-eight hours). It is conceivable that this is because the ink having lower viscosity can easily go through the processed stamp plate 10 and, to the contrary, the ink having higher viscosity hardly seeps through the same.

The ink permeation speed will be described hereinafter. This ink permeation speed was tested by preparing six kinds of ink as well as in the above tests, applying each ink to six points of each figure portion 6 so as to apply a droplet of the ink to each point and measuring the time from the ink dropping time until the ink has been fully permeated into each ink dropped portion of the figure portion 6, and calculating the mean permeation time at ink dropped portions per ink. A droplet of ink in this ink permeation speed test was 6 mmg as well as the above test. In the result concerning the ink permeation speed test in FIG. 10, the ink permeation speed became faster as the viscosity was lower and, to the contrary, it became later as the viscosity was higher.

As a result, an stamping operation can be started sooner as the ink permeation speed is faster, but the ink seeps easily through the figure portion 6. To the contrary, the ink hardly seeps through as the ink permeation speed is later, but it needs the time before the stamping operation startable time. In consideration of those circumstances, the appropriate ink permeation speed is 7–20 seconds (which corresponds to the ink viscosity of 300–2000 cps) and, more suitably, 10–15 seconds (which corresponds to the ink viscosity of 500–1500 cps).

Furthermore, the number of trial stamping times will be described below. This characteristic was tested by preparing six kinds of ink as well as the above, applying the ink separately to the figure portions 6, and counting the number of trial stamping times needed to remove excess ink from the figure portions 6. As shown in FIG. 10, the trial stamping times was fewer as the ink viscosity was lower, while becoming more as the ink viscosity was higher. Though regular stamping operations can be performed many times as the number of trial stamping times is fewer, the number of trial stamping times is preferably ten times in consideration of the proportion with each of characteristics mentioned above. Taking notice of the number of trial stamping times shown in FIG. 10 in view of above, the appropriate viscosity of ink is 300–2000 cps and, more suitably, 500–1500 cps.

It is found that the ink viscosity satisfying all characteristics, i.e., the stamping durability, the ink spreading condition, the ink seeping condition, the ink permeation speed, and the number of trial stamping times is preferably 300 cps–2000 cps and, more appropriately, 500 cps–1500 cps.

As stated above, in the stamp device 11 in the embodiment, the ink to be impregnated into the figure portion 6 of the processed stamp plate 10 is formed of polyoxyethylene-alkyl-phenyl ether and oil soluble dye melted therein and regulated to have the viscosity in a range of 300–2000 cps, more preferably, 500–1500 cps, which makes it possible to improve all of the stamping characteristics needed for the stamp device 11, namely, the stamping durability, the ink spreading condition, the ink seeping condition, the ink permeation speed, and the number of trial stamping times.

Furthermore, the mean diameter of pores formed from the open cells in the figure portion 6 of the processed stamp plate 10 is set in a range of 10–50 $\mu$m and the ink viscosity is regulated in the above mentioned range, so that each of the characteristics can be extremely improved.

The foregoing description of the preferred embodiment of the invention has been presented for purposes of illustration and description. It is not intended to be exhaustive or to limit the invention to the precise form disclosed, and modifications and variations are possible in light of the above teachings or may be acquired from practice of the invention. The embodiment chosen and described in order to explain the principles of the invention and its practical application to enable one skilled in the art to utilize the invention in various embodiments and with various modifications as are suited to the particular use contemplated.

It is intended that the scope of the invention be defined by the claims appended hereto, and their equivalents.

What is claimed is:

1. A method of forming a stamp device comprising the steps of:

providing a porous base plate having open cells therein with a mean diameter of pores being larger than 10 $\mu$m and smaller than 50 $\mu$m;

pressing a heated die to the porous base plate to form melted portions that are ink impermeable;

pressing a thermal head against a surface of the porous base plate to melt selected portions of the surface to create a stamping surface with ink impermeable portions and ink permeable portions; and applying ink to the stamp plate formed of organic solvent and dye melted therein and regulated to have viscosity which is higher than 500 cps and lower than 1500 cps.

2. The method of claim 1, further comprising applying a support member to the porous base plate.

3. The method of claim 1, further wherein the step of pressing the heated die to the porous base plate includes forming an ink impermeable frame around the stamp surface.

4. The method of claim 1, wherein the step of applying ink to the stamp plate includes attaching an ink occlusion pad to a back surface of the porous base plate.

5. The method of claim 1, wherein the step of pressing the thermal head against the porous base plate includes controlling the thermal head so that heating elements on the thermal head selectively emit heat based on image dot patterns.

6. A stamp device comprising the combination of:

a stamp plate formed from a porous base plate having open cells therein with a stamp surface including an ink impermeable melted-solidified portion and an ink permeable non-melted portion, wherein a mean diameter of pores formed from the open cells in the non-melted portion of the stamp plate is larger than 10$\mu$m and smaller than 50 $\mu$m;

an ink impregnated in the ink permeable non-melted portion of the porous base plate and formed of organic solvent and dye melted therein and regulated to have viscosity which is higher than 500 cps and lower than 1500 cps; and a support member for supporting the stamp plate from one side plane of the porous base plate including a receiving part having a rectangular support surface for supporting the stamp plate, and a pair of longitudinal claws formed parallel with both longitudinal sides of the rectangular support surface, the claws resiliently holding the stamp plate.

7. The stamp device according to claim 6, wherein the receiving part has a concave slot portion formed at one side of the support surface and an inclined portion positioned near the concave slot portion, and wherein the stamp plate is set in the receiving part by inserting one end thereof into the concave slot portion while being guided by the inclined portion.

8. The stamp device according to claim 6, further comprising an adhesive layer formed on the support surface, where the stamp plate is fixed on the support surface by the adhesive layer.

* * * * *